US006878048B2

(12) United States Patent
Gotkis et al.

(10) Patent No.: US 6,878,048 B2
(45) Date of Patent: Apr. 12, 2005

(54) CMP BELT STRETCH COMPENSATION APPARATUS AND METHODS FOR USING THE SAME

(75) Inventors: Yehiel Gotkis, Fremont, CA (US); David Wei, Fremont, CA (US); Aleksander Owzarz, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/864,031

(22) Filed: Jun. 8, 2004

(65) Prior Publication Data

US 2004/0224610 A1 Nov. 11, 2004

Related U.S. Application Data

(62) Division of application No. 10/033,501, filed on Dec. 26, 2001, now Pat. No. 6,749,491.

(51) Int. Cl.[7] ..... B24B 21/20

(52) U.S. Cl. ..... 451/296; 451/5; 451/311; 451/499

(58) Field of Search ..... 451/5, 41, 285–289, 451/296, 297, 311, 309, 499

(56) References Cited

U.S. PATENT DOCUMENTS

| | | | | | |
|---|---|---|---|---|---|
| 4,187,645 | A | * | 2/1980 | Lind | 451/297 |
| 4,443,977 | A | * | 4/1984 | Gaiani | 451/309 |
| 5,871,390 | A | * | 2/1999 | Pant et al. | 451/5 |
| 6,261,163 | B1 | * | 7/2001 | Walker et al. | 451/311 |
| 6,428,394 | B1 | * | 8/2002 | Mooring et al. | 451/41 |

* cited by examiner

*Primary Examiner*—Lee D. Wilson
*Assistant Examiner*—Anthony Ojini
(74) *Attorney, Agent, or Firm*—Martine Penilla & Gencarella, LLP

(57) ABSTRACT

An apparatus for reducing non-uniform stretch of a belt used in the CMP system is disclosed. The belt that may be used with the apparatus extends between a first roller and a second roller to define a belt loop with an inner surface and an outer surface to be used for CMP. The apparatus includes a compensating roller that has a first end and a second end where the first end and second end extends a width of the belt. The first end and the second end have a first diameter. The center of the roller has a second diameter that is less than the first diameter. The compensating roller has a symmetrically tapered shape that extends between each of the first end and second end to the center. The compensating roller is positioned inside of the belt loop, and is applied to the inner surface of the belt loop to reduce non-uniform stretch of the belt.

4 Claims, 7 Drawing Sheets

CM P BELT STRETCH COMPENSATION APPARATUS AND METHODS FOR USING THE SAME

CROSS REFERENCE TO RELATED APPLICATION

This application is a divisional of U.S. application Ser. No. 10/033,501, filed Dec. 26, 2001 now U.S. Pat. No. 6,749,491. The disclosure of this parent application, from which priority under 35 U.S.C. § 120 is claimed, is incorporated herein by reference

BACKGROUND OF THE INVENTION

1. Field of the Invention

The present invention relates to chemical mechanical planarization (CMP) techniques and, more particularly, to the efficient, cost effective, and improved CMP operations.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess metallization.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum or copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12 in the prior art, which moves linearly in respect to the surface of the wafer 16. The belt 12 is a continuous belt which is cycled by rollers (or spindles) 20. The rollers are typically driven by a motor so that the rotational motion of the rollers 20 causes the polishing belt 12 to be driven in a motion 22, which is linear with respect to the wafer 16. The wafer 16 is held by a wafer carrier 18. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12. The polishing belt 12 is a continuous belt typically made up of a polymer material such as, for example, the IC 1000 made by Rodel, Inc. layered upon a supporting layer. The support layer is generally made from a firm material such as stainless steel. The polishing belt 12 is rotated by the rollers 20 which drives the polishing belt in the linear motion 22 with respect to the wafer 16. In one example, an air bearing platen 24 supports a section of the polishing belt under the region where the wafer 16 is applied. The platen 24 can then be used to apply air against the under surface of the supporting layer. The applied air thus forms an controllable air bearing that assists in controlling the pressure at which the polishing belt 12 is applied against the surface of the wafer 16.

Unfortunately, in typical CMP systems, when a circular object such as a wafer, for example is pressed down upon a surface, which is rectangularly shaped such as the stretched polishing pad 12, uneven stretching of the pad surface may occur which is akin to a ripple effect. This is due to uneven nonlinear forces acting on the rectangular surface. A central portion is stretched and the edges of the rectangular surface are not stretched so the sides of the rectangular surface are up. The air bearing platen may be utilized to try to smooth the ripple effects and reduce the uneven stretching by applying higher air pressure to the polishing pad, but this results in significant increase in air consumption and still does not result complete elimination of the ripple effects, especially in the wafer edge area.

FIG. 1C illustrates the ripple effect in a static environment where a wafer 16 is pressed against a linear polishing pad 12. A loaded wafer, pressing over the elastic surface of the polishing pad causes a transient pad deformation zone near a wafer edge, which, being accompanied with the wafer relative tangential motion, creates a quickly attenuating longitudinal-transversal pad deformation wave. This results in re-distribution of pad-wafer contact force, affecting the removal rate and resulting in the edge effect. The forces causing the removal rate variations are shown by force arrows 26 and 28. Removal variations of up to 50% from the average may be observed due to the edge effects.

Linear belt CMP technology as described in FIGS. 1A and 1B has a reasonably flexible and stretchable polishing surface. The air bearing pad support utilized in the linear belt CMP provides a capability for manipulation of the pad shape and the contact force distribution enabling the minimizing of the edge effects up to 2 mm of edge exclusion. Unfortunately, one of the significant disadvantages of the air bearing is the circular symmetry of both upper surface and air providing orifices, which leads to high air consumption. During a CMP process, when the wafer 16 is pushed onto the polishing pad 12, the pad 12 deforms where a plurality of ripples 24 are formed. The ripples 24 are portions of the polishing pad 12 which moves up from its previous position due to the pressure applied by the wafer. The portions of the polishing pad 12 that are moved up exerts greater polishing force on the wafer 16. The effects of the ripples 24 at the edge of the wafer are especially pronounced resulting in an edge effect (removal variations at the wafer edge) where edge polishing rates are significantly higher than polishing rates at the center of the wafer 16.

FIG. 1D shows polishing effects of the ripples that may be formed when the non-rotating (static) wafer 14 is pressed down onto the polishing pad 12. Therefore, because of the aforementioned ripple effect, certain portions of the wafer as shown by areas 32 are polished more than the remaining areas of the wafer 16.

FIG. 1E shows polishing effects of the ripples when an air bearing platen is utilized underneath a polishing pad. In this example, an air bearing platen blowing air underneath a center portion of the polishing pad pushes up on the polishing pad where a center portion of the wafer is typically polished. The ripples are therefore reduced by the air pressure and wafer polishing in the wafer center is not as pronounced as shown in FIG. 1D. Therefore, less portions of the wafer 14 have uneven polishing. Unfortunately, usage of typical air bearing platen do not enable correction of excessive polishing in a plurality of areas 40 as shown in FIG. 1E.

As a result, because of the rectangular shape of a typical linear polishing belt and its interaction with a circular distortion from the air bearing creates a non-linear pad stretching field resulting in surface rippling which finally results in uneven polishing of the wafer due to uneven polishing pressure applied by different portions of the polishing pad.

Therefore, there is a need for a method and an apparatus that overcomes the problems of the prior art by having an apparatus that may be utilized to correct stress distribution in a polishing pad so polishing pressure applied by the polishing pad to the wafer is consistent through different sections of the wafer. Such an apparatus additionally stretch the under-stretched belt sections to enable more consistent and effective polishing in a CMP process without requiring large air consumption.

SUMMARY OF THE INVENTION

Broadly speaking, the present invention fills these needs by providing an improved method and apparatus for reducing non-uniform stretch resulting in the evening of the polishing pressure across a wafer by using a profiled roller to manage the polishing forces that a linear polishing belt applies to the wafer during chemical mechanical planarization (CMP) process. The present invention utilizes a profiled roller or a plurality of smaller rollers manipulating the stretch distribution across the polishing belt to compensate for the stretch variations and suppress the rippling effect yielding in a more robust process window and reduced air consumption. It should be appreciated that the present invention can be implemented in numerous ways, including as a process, an apparatus, a system, a device or a method. Several inventive embodiments of the present invention are described below.

In one embodiment, an apparatus for reducing non-uniform stretch of a belt used in the CMP system is disclosed. The belt that may be used with the apparatus extends between a first roller and a second roller to define a belt loop with an inner surface and an outer surface to be used for CMP. The apparatus includes a compensating roller that has a first end and a second end where the first end and second end extends a width of the belt. The first end and the second end have a first diameter. The center of the roller has a second diameter that is less than the first diameter. The compensating roller has a symmetrically tapered shape that extends between each of the first end and second end to the center. The compensating roller is positioned inside of the belt loop, and is applied to the inner surface of the belt loop to reduce non-uniform stretch of the belt.

In another embodiment, an apparatus for reducing non-uniform stretch of a belt used in the CMP system is disclosed. The belt that may be used with the apparatus extends between a first roller and a second roller to define a belt loop with an inner surface and an outer surface to be used for CMP. The apparatus includes a compensating roller that has a first end and a second end. The first end and second end extends the width of the belt. The first end and the second end have a first diameter. The center of the roller has a second diameter that is less than the first diameter. The compensating roller has a symmetrically tapered shape that extends between each of the first end and second end to the center. The apparatus also includes a force applicator coupled to the compensating roller. The force applicator supplies a pressing motion to the compensating roller. The apparatus further includes a system force controller in communication with the force applicator where the system force controller manages an amount of force utilized by the force applicator. The compensating roller is positioned inside of the belt loop, and is configured to be applied to the inner surface of the belt loop so as to reduce non-uniform stretch of the belt.

In yet another embodiment, an apparatus for reducing non-uniform stretch of a belt used in the CMP system is disclosed. The belt that may be used with the apparatus extends between a first roller and a second roller to define a belt loop with an inner surface and an outer surface to be used for CMP. The apparatus includes a first compensating roller positioned inside of the belt loop where the first compensating roller is applied to the inner surface of the belt loop so as to press against a first edge of the belt. The apparatus also includes a second compensating roller positioned inside of the belt loop. The second compensating roller is applied to the inner surface of the belt loop so as to press against a second edge of the belt. The application of the first compensating roller and the second compensating roller to the inner surface of the belt loop reduces non-uniform stretch of the belt.

The advantages of the present invention are numerous. Most notably, by utilizing a CMP system where a profiled roller applies selective force, pressure may be applied to selective areas of a polishing pad to relieve non-uniform stretch and uneven tension across the polishing pad. Therefore, the present invention may normalize planarization polishing pressure across the polishing pad without the need of applying large amounts of air through an air bearing platen. In contrast to the prior art, polishing pressures may be made more consistent in all areas of the wafer by applying force to the edges of the polishing pad to correct the stress distribution of the polishing pad. In addition, air consumption may be optimized with the present invention because an air bearing platen does not have to apply as much as air to even the tension across the polishing pad.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

A method and apparatus for correcting the stress distribution of the polishing belt during chemical mechanical planarization (CMP) is provided. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward utilizing force applying apparatuses to generate displacement and pressure on certain portions of a polishing pad utilized in CMP operations to reduce non-uniform stretch and correct uneven stress distribution across the pad. In preferable embodiments, the method and apparatus involves utilizing a roller or a plurality of rollers to displace and in this way to increase pressure on the under-stretched edges along the width of the polishing belt which significantly reduces rippling of the polishing pad during CMP operations. It should be understood that the polishing belt can include any number of layers, including a single pad material (e.g., polymeric polishing layer), a supported pad material (e.g., a polymeric polishing pad supported by a stainless steel layer), or multi-layer pad materials with cushioning layers (e.g. a polymeric polishing pad over a cushioning layer that is in turn supported by a stainless steel layer), etc. Therefore, the polishing pressure on wafers being processed is more consistent thereby enabling the outer portions of the wafer away from the center to be polished at a substantially the same rate as the center of the wafer.

It should be understood that the present invention may be utilized to correct stress distribution on any type of polishing mechanism such as, for example, a linear polishing CMP apparatus. The present invention may also be utilized to optimize wafer polishing operations involving any size or types of wafers such as, for example, 200 mm semiconductor wafers, 300 mm semiconductor wafers, etc. The present invention therefore can enable optimized, more efficient, and more consistent wafer polishing operations in numerous types of CMP processing systems.

Figure 1A:
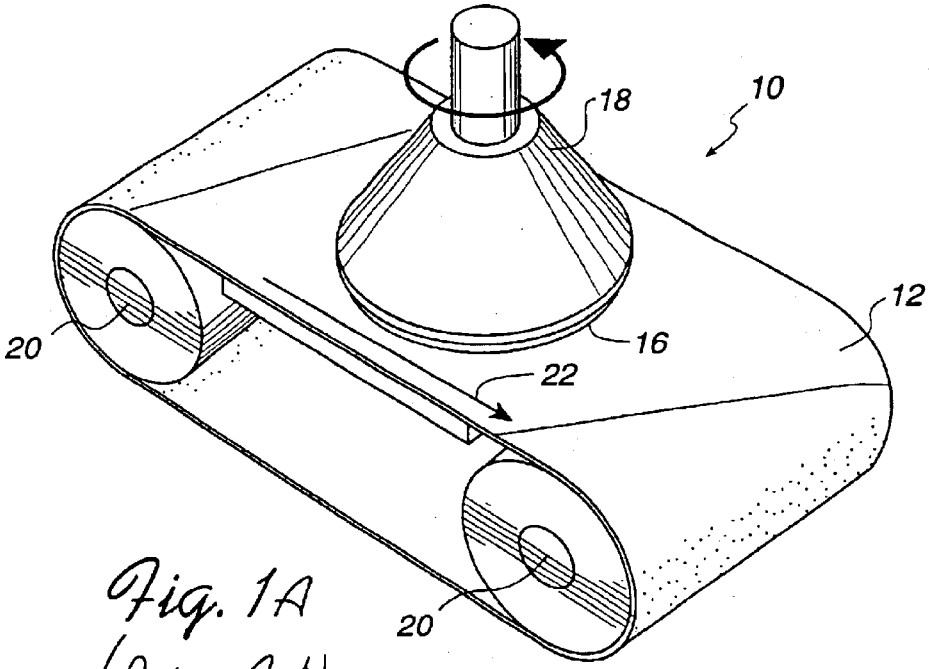
Fig. 1A (Prior Art)
FIG. 1A shows a linear polishing apparatus which is typically utilized in a CMP system.
Figure 1B:
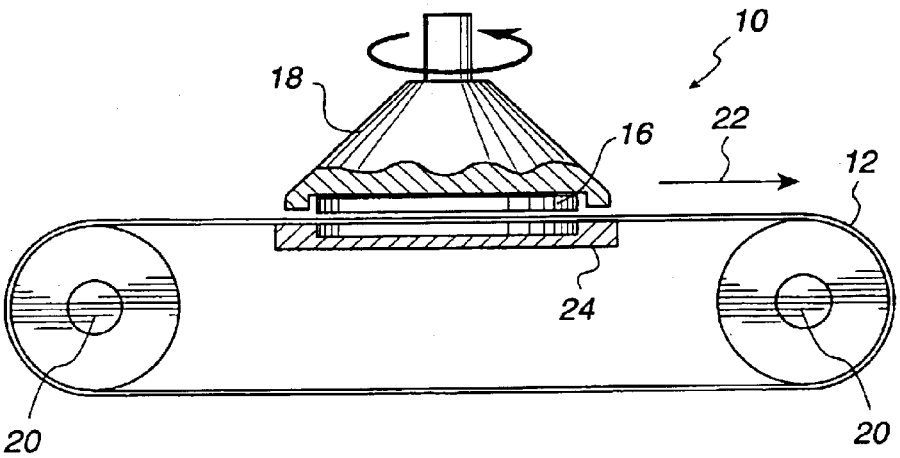
Fig. 1B (Prior Art)
FIG. 1B shows a side view of the linear polishing apparatus.
Figure 1C:
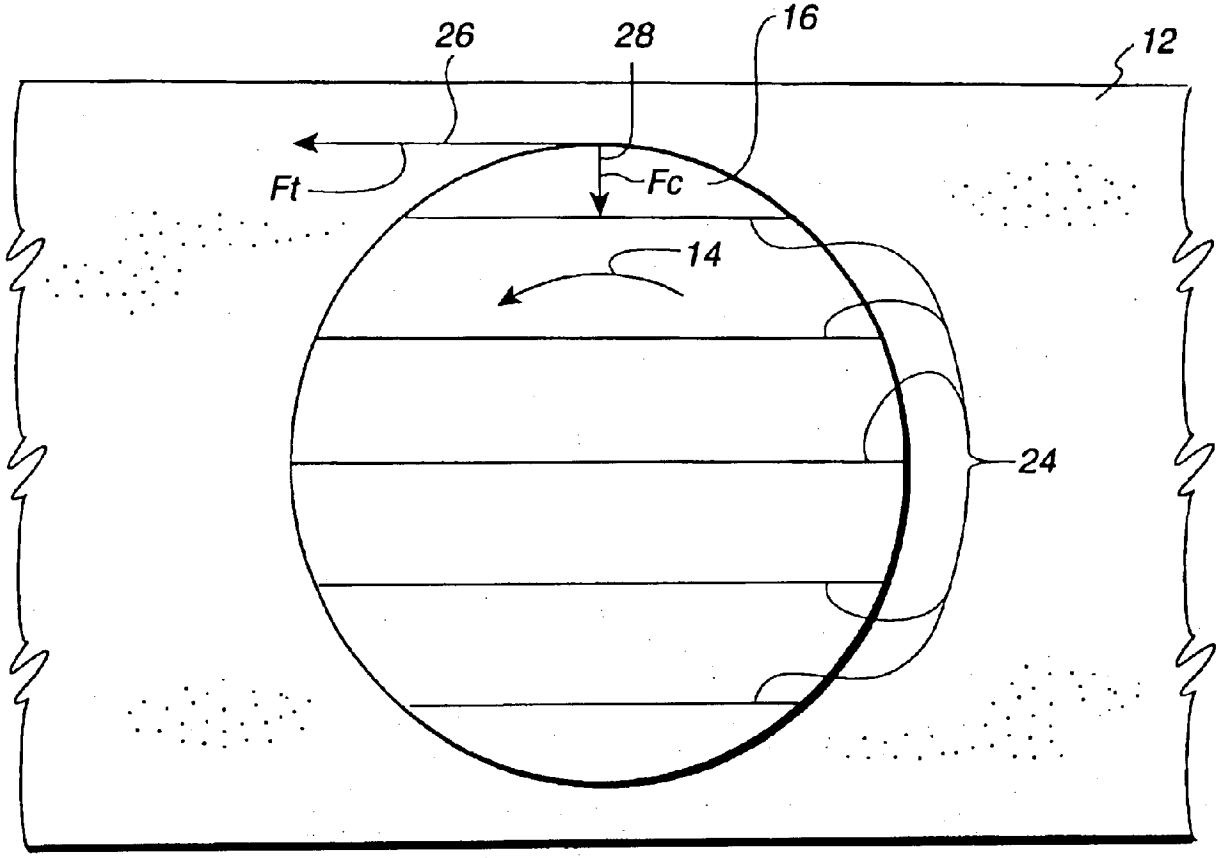
Fig. 1C (Prior Art)
FIG. 1C illustrates the ripple effect in a static environment where a wafer is pressed against a linear polishing pad.
Figure 1D:
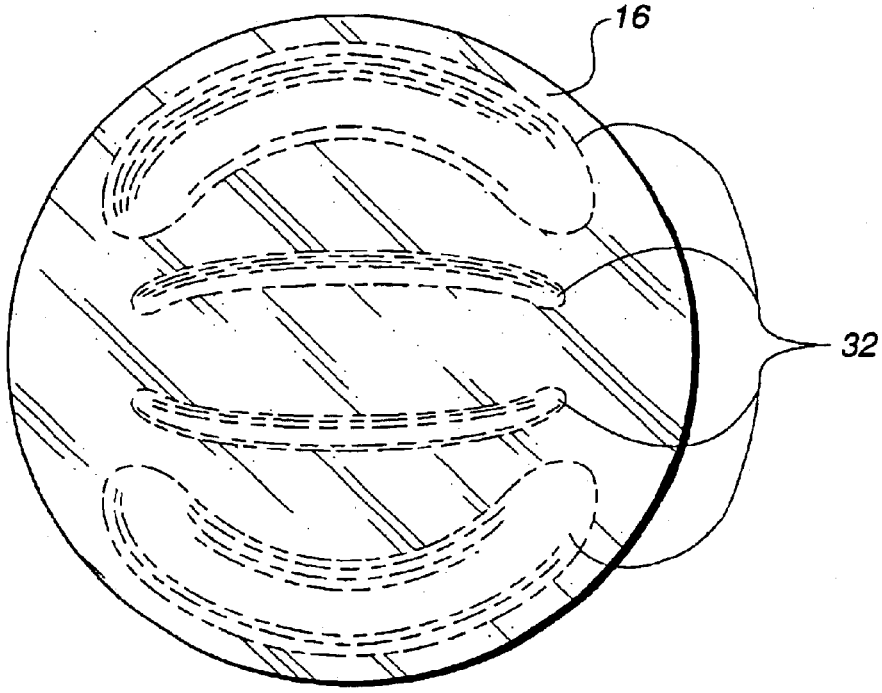
Fig. 1D (Prior Art)
FIG. 1D shows polishing effects of the ripples that may be formed when the wafer is pressed down onto the polishing pad.
Figure 1E:
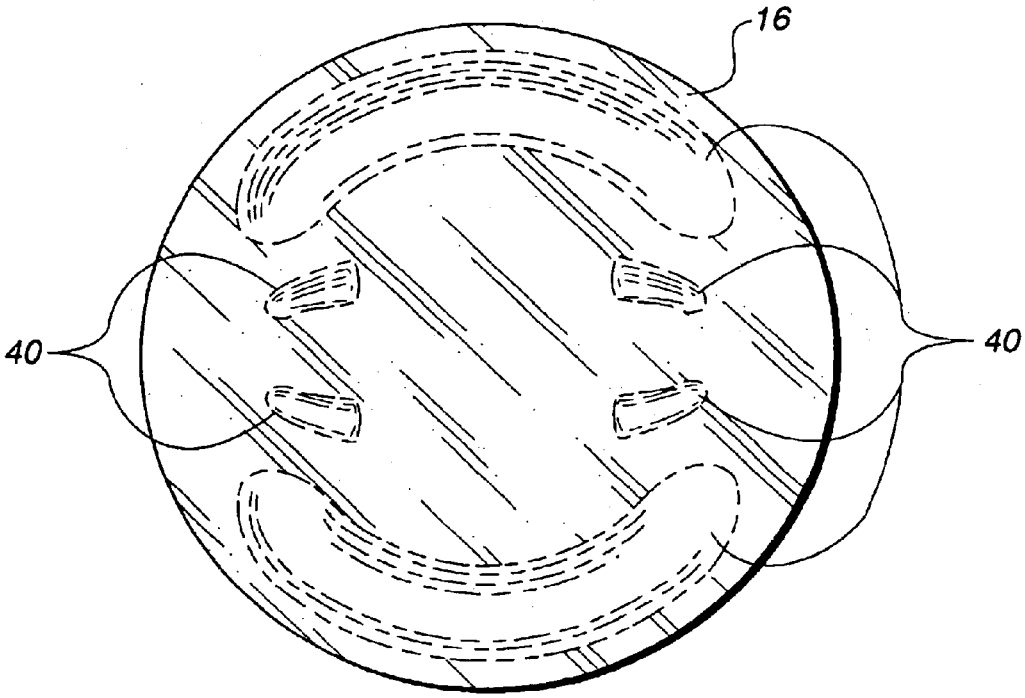
Fig. 1E (Prior Art)
FIG. 1E shows polishing effects of the ripples when an air bearing platen is utilized underneath a polishing pad.
Figure 2:
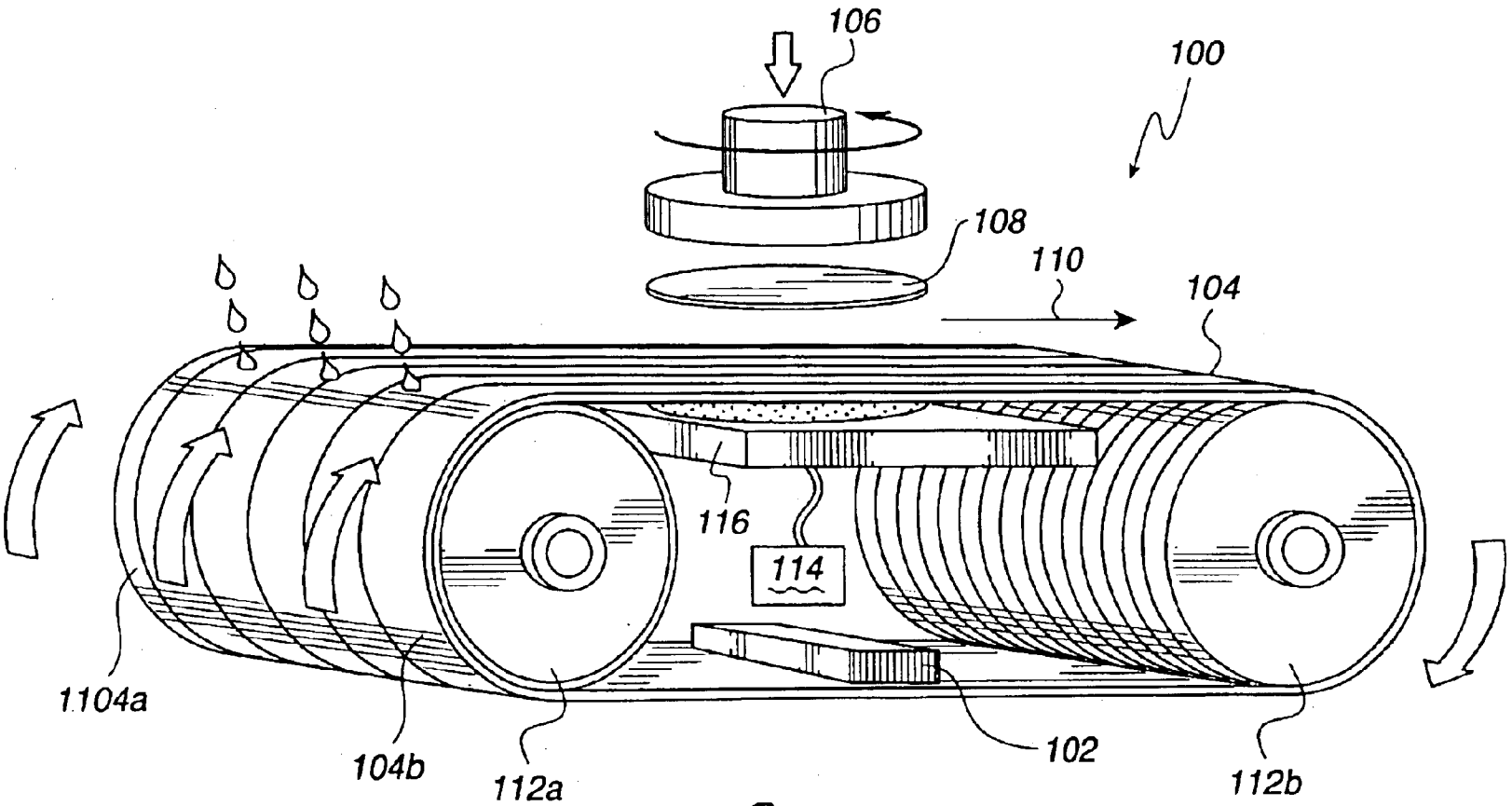
FIG. 2 shows a CMP system according to one embodiment of the present invention.

FIG. 2 shows a CMP system 100 according to one embodiment of the present invention. A polishing head 106 may be used to secure and hold the wafer 108 in place during wafer polishing operations. A polishing belt 104 forms a continuous belt loop around rollers 112*a* and 112*b*. The polishing belt 104, in one embodiment, is a belt type polishing belt utilized in linear CMP systems. The polishing belt 104 is generally rotated in a direction indicated by a direction 110 at a speed of about 400 feet per minute by a first roller 112*a* and a second roller 112*b*, although this speed may vary depending upon the specific CMP operation. As the polishing belt 104 rotates, polishing slurry may be applied and spread over the surface of the polishing belt 104. The polishing head 106 may then be used to lower the wafer 108 onto the surface of the rotating polishing belt 104. A platen 116 may support the polishing belt 104 during the polishing process. The platen 116 may utilize any type of bearing such as a gas bearing. Fluid pressure from a fluid source 114 is inputted into the platen 116 by way of a plurality of output holes may be utilized to push up on the polishing belt 104 to control the polishing belt profile. In this manner, the surface of the wafer 108 that is desired to be planarized is substantially smoothed in an even manner.

In some cases, the CMP operation is used to planarize materials such as copper (or other metals), and in other cases, it may be used to remove layers of dielectric or combinations of dielectric and copper. The rate of planarization may be changed by adjusting the polishing pressure. The polishing rate is generally proportional to the amount of polishing pressure applied to the polishing belt against a platen 116. Although in a preferable embodiment, the platen 116 uses air as a bearing, it should be understood that any other type of fluid may be utilized as the bearing between the platen 116 and the polishing belt 104. After the desired amount of material is removed from the surface of the wafer 108, the polishing head 106 may be used to raise the wafer 108 off of the polishing belt 104. The wafer 108 is then ready to proceed to a wafer cleaning system.

The CMP system 100 includes a tension compensating apparatus 102 that may be placed in any location in the CMP system as long as a profiled roller or a plurality of force applicators (as discussed in reference to FIGS. 3, 4, and 5 below) may be applied to the polishing belt 104 without adversely affecting operations of other parts of the CMP system 100. The tension compensating apparatus 102 may also be incorporated into other structures within the CMP system 100. In one embodiment, the tension compensating apparatus 102 is located in a bottom portion of the CMP system 100 below where the platen 116 is located. The configuration of the tension compensating apparatus 102 is discussed further detail in reference to FIGS. 3–5.

It should be appreciated that the tension compensating apparatus 102 may apply pressure to any portion of the polishing belt 104 as long as tension across the width of the polishing belt 104 may be made more consistent. In one embodiment, by applying pressure to a first edge 104*a* and a second edge 104*b* along the width of the polishing belt 104, tension along different sections of the polishing belt 104 may be managed more effectively to enable more efficient and consistent polishing for different sections of the wafer. Pressure applied to the edges 104*a* and 104*b* enables significant reduction of the "ripple" effect that occurs when a rectangular sheet applies pressure to a circular object. This results in optimized wafer polishing due to greater consistency of polishing rates across the wafer as further discussed in reference to FIG. 6.

Figure 3A:
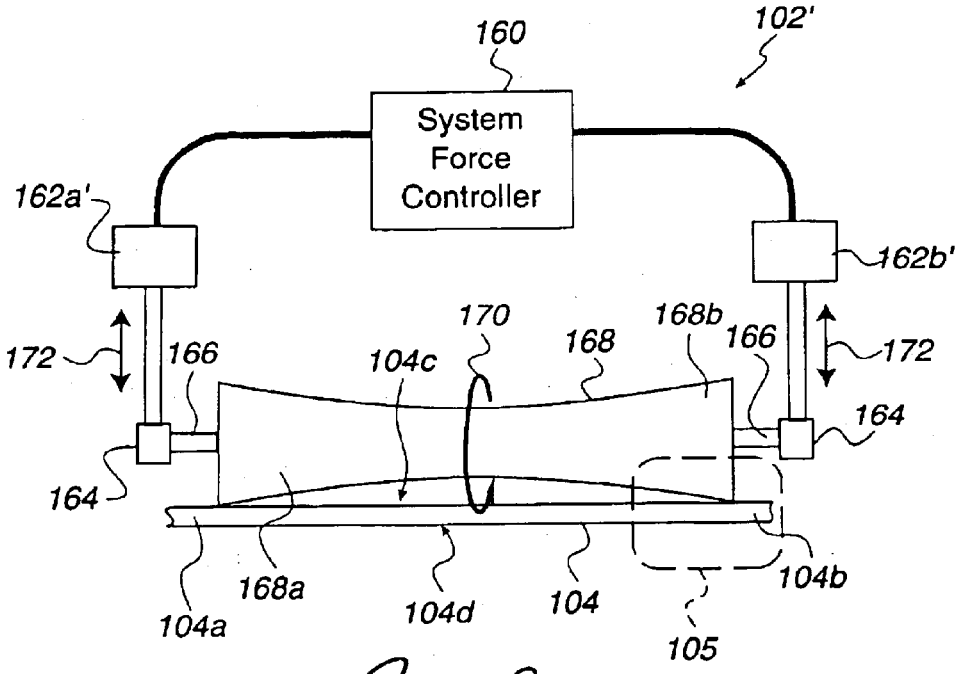
FIG. 3A illustrates a tension compensating apparatus in accordance with one embodiment of the present invention.

FIG. 3A illustrates a tension compensating apparatus 102 in accordance with one embodiment of the present invention. In this figure, the tension compensating apparatus 102 is shown from a front view (i.e., the line of sight is the axis in the direction of belt travel). In this embodiment, the tension compensating apparatus 102 includes a system force controller 160 that is connected to force applicators 162*a* and 162*b*. The force applicators 162*a* and 162*b* are connected to a spindle 164 which is coupled to a profiled roller 168. A close-up view 105 of the interface between the profiled roller 168 and the polishing belt 104 is discussed in reference to FIG. 3B.

The system force controller 160 may determine how much downward pressure, as shown by directions 172*a* and 172*b*, the force applicators 162*a* and 162*b* may apply to the profiled roller 168 which in turn can apply selective pressure to edges 104*a* and 104*b* of the polishing belt 104. In one embodiment, the system force controller 160 may be manual force controlling device. In another embodiment, the system force controller 160 may be an automatically operated device utilizing any type of logic that can monitor pressure applied to the polishing belt and that can manage the force applicators 162*a* and 162*b* to supply a force pushing the profiled roller 168 against the belt 104. It should be understood that profiled roller 168 may also be known as a compensating roller. In this embodiment, by a feedback loop, the tension compensating apparatus 102 may apply force to certain areas of the polishing belt 104 to relieve any uneven tension in the polishing belt. It should be appreciated that the force applicators 162*a* and 162*b* may apply force to the profiled roller 168 by use of any type of force producing device such as, for example, hydraulic actuated pistons, air bladders, piezoelectrics, magnetic actuators, etc. controlled in any type of manner. The profiled roller 168 may rotate in a direction 170 which moves in the same direction as the direction of the rotating rollers 112*a* and 112*b* as shown in FIG. 2. The profiled roller 168 is configured so the ends of the roller 168 apply pressure to edges 104*a* and 104*b* of an inner surface 104*c* of the polishing belt 104. An outer surface 104*d* is used for polishing purposes. By applying pressure to the edges 104*a* and 104*b* of the polishing belt 104, the stress distribution through the polishing belt 104 may be made more consistent. As can be seen, a multitude of configurations may be utilized to enable the desired effects of equalized polishing belt tension.

Typically, without use of the tension compensating apparatus 102, the polishing belt 104 may have tension irregularities. With use of the profiled roller 168, the edges 104*a* and 104*b* of the polishing belt 104 may stretch the polishing belt from the edges which may even out the stress distribution when the wafer 108 is applied to a surface of the polishing belt 104. It should be understood that the profiled roller may be configured in any way where pressure can applied to the edges 104*a* and 104*b* of the polishing belt 104. In one embodiment, the profiled roller 168 has a first end 168*a* and a second end 168*b* which extend along the width of the polishing belt 104. The ends 168*a* and 168*b* have a same diameter that is larger than a diameter of the center portion 168*c* of the roller 168. In such an embodiment, the profiled roller 168 has a symmetrically tapered shape extending between each of the first end 168*a* and second end 168*b* to the center 168*c*. Therefore, the middle portion of the profiled roller 168 does not contact the polishing belt 104. It should be appreciated that the profiled roller 168 may be any dimension which would enable it to apply pressure to the edges 104*a* and 104*b* of the polishing belt 104. It should also be understood that the profiled roller 168 may be made from any material that may be strong enough and corrosion resistible such as, for example, hard rubber material, polyurethane material, stainless steel, ceramics, and even polymers, to apply correct pressure to the polishing pad 104 so non-uniform tension may be reduced. In another embodiment, the roller 168 may be a "barbell" shape where two are attached by a spindle. Again, the disk section touches the polishing belt 104 but the spindle section does not. The shape and position of the profiled roller 168 may be adjusted to optimize the removal rate profile and air consumption.

Figure 3B:
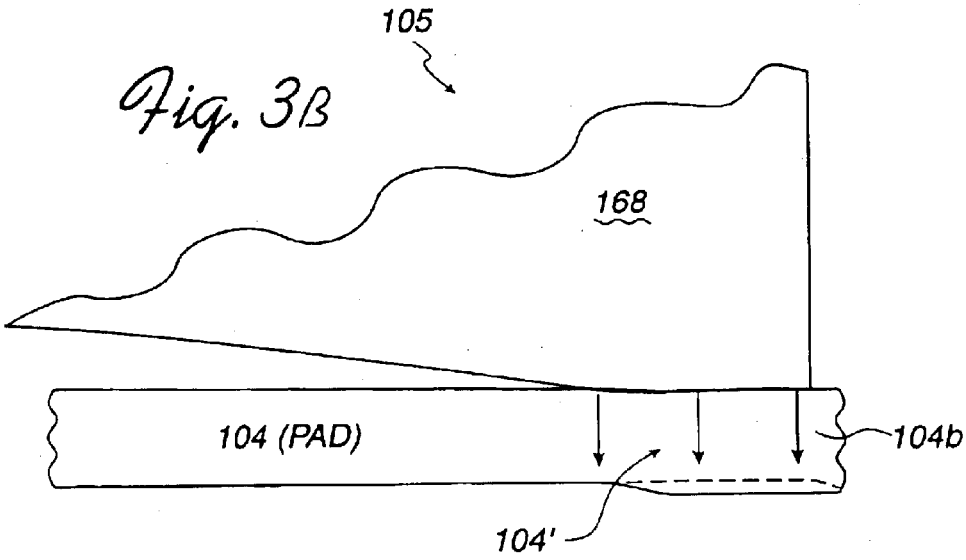
FIG. 3B illustrates a tension compensating apparatus in accordance with one embodiment of the present invention.

FIG. 3B shows a close-up view 105 of the interface between the profiled roller 168 and the polishing pad 104 in accordance with one embodiment of the present invention. In this embodiment, the profiled roller 168 is used to press down on the edge 104*b* of the polishing belt 104. When the edge 104*b* is pressed down, the polishing pad 104 becomes stretched into position 104'. Once the polishing pad 104 reaches the position 104', non-uniform stretch of the polishing belt 104 is reduced. As discussed in reference to FIG. 6, the reduction in non-uniform stretch results in more consistent wafer polishing.

Figure 4:
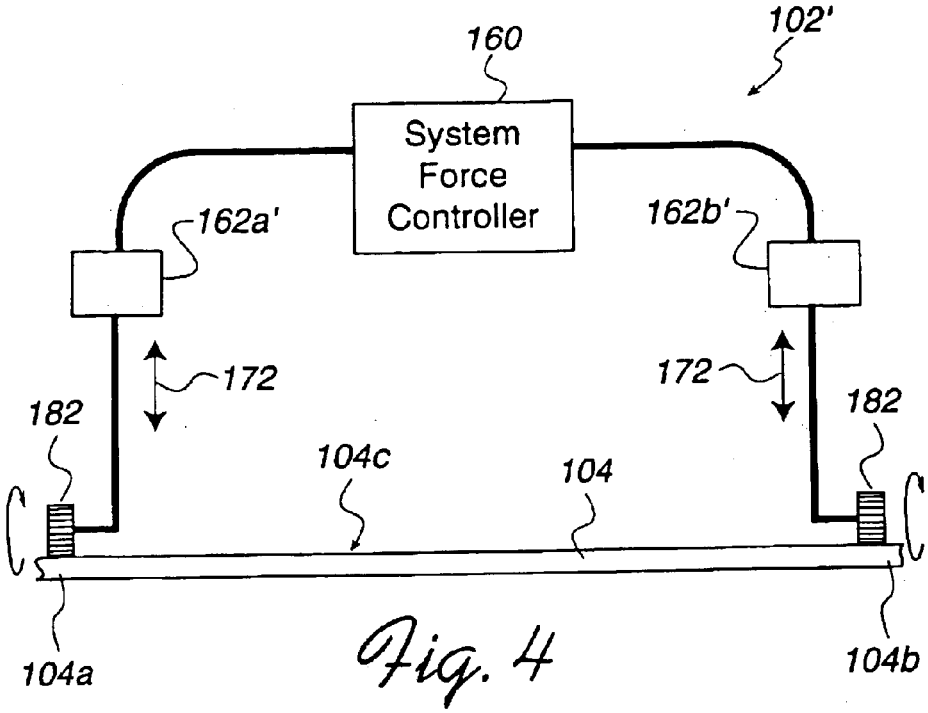
FIG. 4 shows a tension compensating apparatus that utilizes two separate rollers in accordance with one embodiment of the present invention.

FIG. 4 shows a tension compensating apparatus 102' that utilizes two separate rollers in accordance with one embodiment of the present invention. The view perspective of FIG. 4 is the same as described in FIG. 3. In this embodiment, the tension compensating apparatus 102' includes the system force controller 160 which controls force applicators 162*a*' and 162*b*' which are coupled to rollers 182*a* and 182*b* respectively. The force applicators 162*a*' and 162*b*' may apply different amounts of force to the rollers 182*a* and 182*b* respectively so differing amounts of force may be applied to two different locations of the polishing belt 104 depending on the requirements or adjustments to polishing desired. In one embodiment, the rollers 182*a* and 182*b* are configured to apply force to the edges 104*a* and 104*b* on the inner surface 104 of the polishing belt 104. Application of force to edges 104*a* and 104*b* can reduce non-uniform stretch (i.e. reduce the rippling effects) of the polishing belt 104 during CMP operations and therefore increase wafer polishing consistency.

Figure 5:
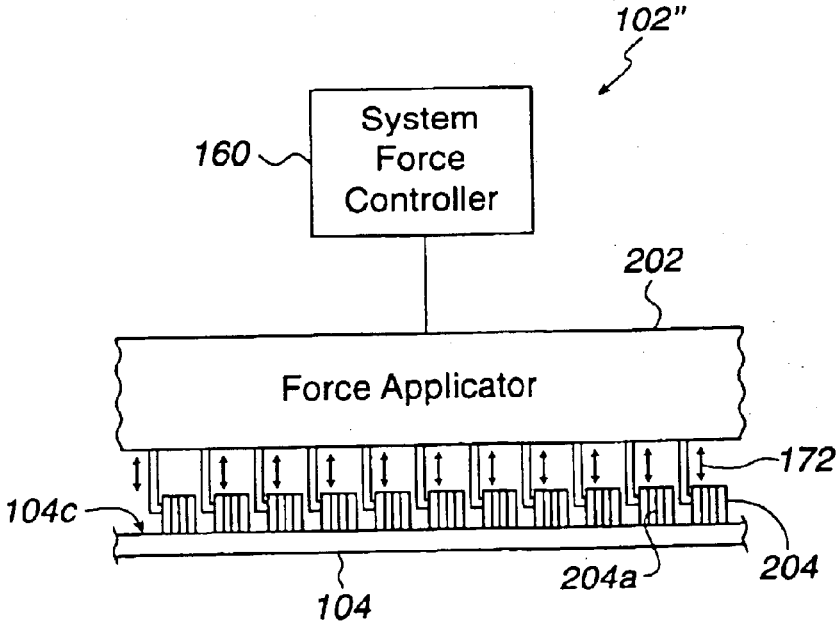
FIG. 5 shows a tension compensating apparatus that utilizes a plurality of force transmitters in accordance with one embodiment of the present invention.

FIG. 5 shows a tension compensating apparatus 102" that utilizes a plurality of force transmitters 204 in accordance with one embodiment of the present invention. In this embodiment, the tension compensating apparatus 102" includes a system force controller 160 that connects and manages a force applicator 202. The force applicator 202 is coupled to the plurality of force transmitters 204. The plurality of force transmitters 204 are configured to apply pressure to the inner surface 104*c* of the polishing pad 104. It should be understood that the plurality of force transmitters 204 may include any number of individual force transmitters. In one embodiment, the plurality of force transmitters 204 are a plurality of air bearing generators. In this embodiment, individual ones of the plurality of air bearing generators are controlled separately by the system force controller through the force applicator 202 thereby enabling different forces to be applied to different portions of the polishing belt 104 by the plurality of air bearing generators. In this embodiment, air may be introduced to the plurality of force transmitters 204 by the force applicator 202. Each of the plurality of air bearing generators may have a plurality of air holes 204*a*. Therefore, by air injection through the plurality force transmitters 204, small areas of air bearings may be created by the air flows from the air bearing generators. The air bearings can then push on the inner surface 104*c* of the polishing belt 104 to reduce non-uniform stretch of the polishing belt 104. By controlling which of the plurality of force transmitters 204 outputs air, pressure may be generated against various sections of the polishing belt 104. Such flexibility can enable a wide range of polishing belt tension adjustments to adjust for polishing rate variances in different parts of the wafer.

In addition to utilizing air to create pressure on specific parts of the polishing belt 104, in one embodiment, the plurality of force transmitters can also be mechanically moved up and down to generate pressure on the polishing belt 104. In yet another embodiment, the plurality of force transmitters may be a plurality of rollers. Each of the plurality of rollers may be similar in structure and functionality to ones as described in reference to FIG. 4.

Figure 6:
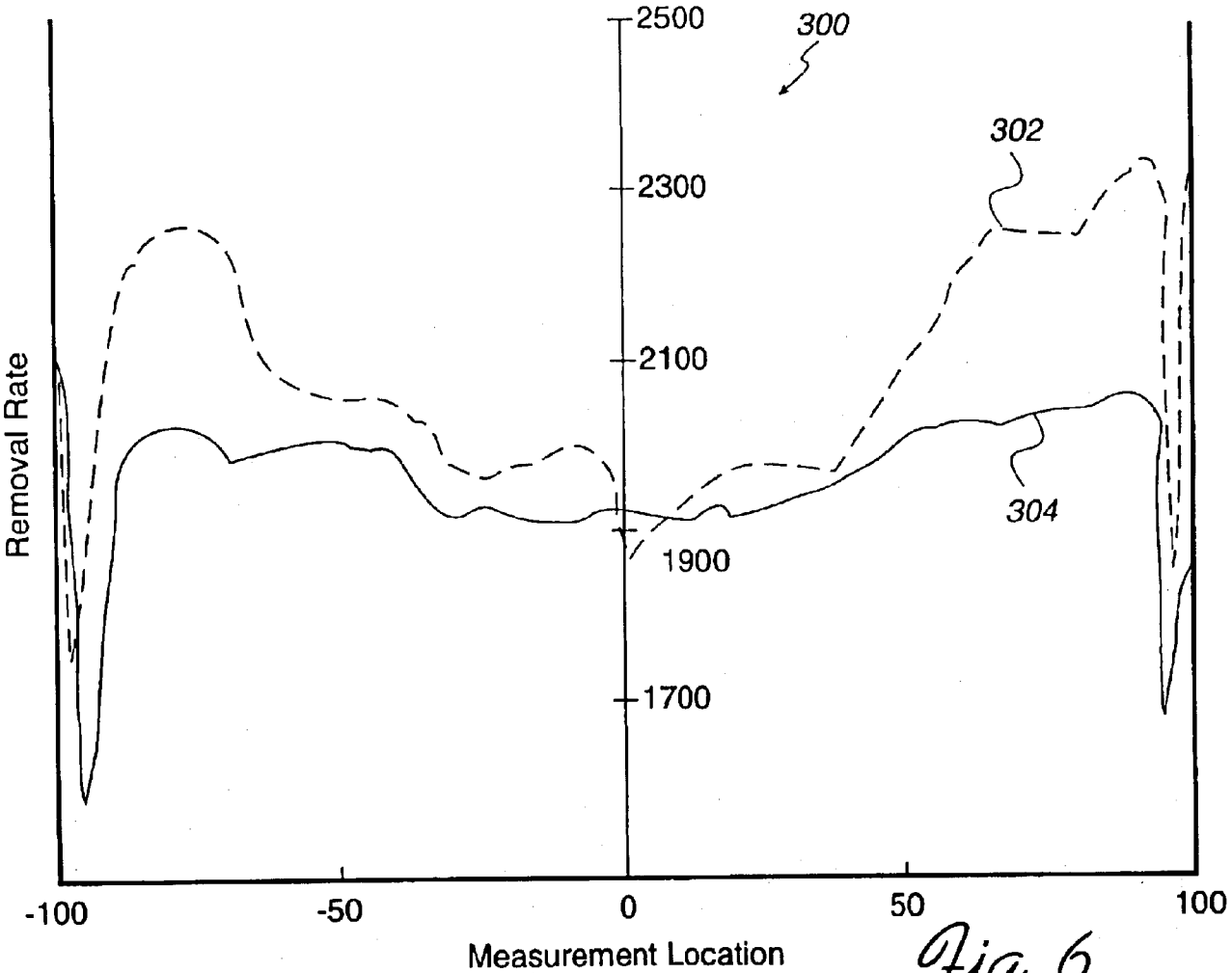
FIG. 6 shows a graph illustrating the polishing rates of a CMP system using a tension compensating apparatus in accordance with one embodiment of the present invention.

FIG. 6 shows a graph 300 illustrating the polishing rates of a CMP system using a tension compensating apparatus 102 in accordance with one embodiment of the present invention. The graph 300 shows a removal rate on the y-axis and a measurement location (as shown as distance from a center of a wafer) on the x-axis. A line 304 shows the relationship between wafer location and polishing rate for a wafer polished using the tension compensating apparatus 102 of the present invention. A line 302 shows polishing rates for a wafer polished by a prior art CMP system. As polishing rates from the center of the wafer (as shown by 0 on the measurement location axis) to the edge of the wafer (as shown by −100 and 100 on the measurement location axis) are measured, the variations in the removal rate (i.e. polishing rate) of the prior art CMP system are much greater than the variations in removal rate of the CMP system with the force application system of the present invention. The present invention is especially effective in reducing polishing variation near the edge of the wafer.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. In a chemical mechanical planarization (CMP) system, an apparatus for reducing non-uniform stretch of a belt used in the CMP system, the belt extending between a first roller and a second roller to define a belt loop with an inner surface and an outer surface to be used for CMP, the apparatus comprising:

a first compensating roller positioned inside of the belt loop, and the first compensating roller being configured to be applied to the inner surface of the belt loop so as to press against a first edge of the belt; and a second compensating roller positioned inside of the belt loop, the second compensating roller being configured to be applied to the inner surface of the belt loop so as to press against a second edge of the belt;

wherein the application of the first compensating roller and the second compensating roller to the inner surface of the belt loop reduces non-uniform stretch of the belt.

2. In a chemical mechanical planarization (CMP) system, an apparatus for reducing non-uniform stretch of a belt used in the CMP system as recited in claim 1, wherein the application of the first compensating roller to the inner surface of the belt loop and the application of the second compensating roller to the inner surface of the belt loop are controlled independently of each other.

3. In a chemical mechanical planarization (CMP) system, an apparatus for reducing non-uniform stretch of a belt used in the CMP system as recited in claim 1, further comprising:

a force applicator, the force applicator being configured to supply a pressing motion to push the first compensating roller and the second compensating roller against the belt.

4. In a chemical mechanical planarization (CMP) system, an apparatus for reducing non-uniform stretch of a belt used in the CMP system as recited in claim 1, wherein the first compensating roller and the second compensating roller are made from one of a hard rubber material and a polyurethane material.

* * * * *